US008191562B1

(12) United States Patent
Sampson

(10) Patent No.: US 8,191,562 B1
(45) Date of Patent: Jun. 5, 2012

(54) TELESCOPIC UMBRELLA WITH INTEGRAL ANCHOR

(76) Inventor: Michael M. Sampson, Altadena, CA (US)

( * ) Notice: Subject to any disclaimer, the term of this patent is extended or adjusted under 35 U.S.C. 154(b) by 44 days.

(21) Appl. No.: 12/860,492

(22) Filed: Aug. 20, 2010

(51) Int. Cl.
*A45B 3/00* (2006.01)

(52) U.S. Cl. ..... 135/16; 135/118; 248/530

(58) Field of Classification Search ..... 135/143, 135/118, 16; 150/154; 206/349, 523, 365, 206/443, 553, 315.11, 338, 371, 477; 224/232, 224/234, 249; 248/530, 532; 30/151, 152, 30/164.7, 164.8
See application file for complete search history.

(56) References Cited

U.S. PATENT DOCUMENTS

| | | | | | |
|---|---|---|---|---|---|
| 2,554,887 | A * | 5/1951 | Tricarico | 248/545 |
| 2,863,466 | A | 12/1958 | Small | |
| 3,834,526 | A * | 9/1974 | Zine, Jr. | 206/528 |
| 4,153,091 | A * | 5/1979 | Jahn | 206/523 |
| D259,176 | S * | 5/1981 | Hofer | D9/759 |
| 5,339,847 | A * | 8/1994 | Kanter et al. | 135/16 |
| 5,473,839 | A * | 12/1995 | Stidham | 47/47 |
| 5,518,218 | A * | 5/1996 | Leonard | 248/530 |
| 5,921,035 | A * | 7/1999 | Kempf | 52/157 |
| 6,199,569 | B1 | 3/2001 | Gibson | |
| 6,371,139 | B1 * | 4/2002 | Simchori | 135/20.1 |
| 6,490,823 | B1 * | 12/2002 | Ibarra | 43/21.2 |
| 6,715,503 | B2 | 4/2004 | Brooks, III | |
| 6,866,053 | B2 | 3/2005 | You | |
| 6,953,180 | B1 * | 10/2005 | Ruvalcaba et al. | 248/530 |
| 7,380,561 | B2 * | 6/2008 | Nobert et al. | 135/118 |
| 7,537,016 | B1 * | 5/2009 | You | 135/16 |
| 2006/0272687 | A1 | 12/2006 | Tanner et al. | |
| 2010/0200724 | A1 * | 8/2010 | Kukuk | 248/530 |

* cited by examiner

*Primary Examiner* — Noah Chandler Hawk

(57) ABSTRACT

A telescopic umbrella with integral anchor which has parallel dual spikes integrated into the support shaft and a parallelepiped foot pad member disposed in a position perpendicular to the dual spikes upon which a user steps to insert and anchor the spikes into the ground thereby securing the umbrella canopy in place. An alignment tab on an upper attachment end of the support shaft and an alignment groove on an opposite securement end of the support shaft assist in the insertion of the upper attachment end into the securement end while aligning and engaging a locking protrusion on the upper attachment end with one of the holes on the securement end to adjust the height of the support shaft. A protective cover is also provided to removably contain and secure the spikes and the foot pad member during period of non-use to prevent personal injury due to accidental contact therewith.

5 Claims, 2 Drawing Sheets

TELESCOPIC UMBRELLA WITH INTEGRAL ANCHOR

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of umbrellas and anchoring accessories therefor are known in the prior art. However, what is needed is a telescopic umbrella with integral anchor which includes an sun umbrella canopy with a locking protrusion to adjust the support shaft to a desired height and which has parallel dual spikes integrated into the support shaft and a parallelepiped foot pad member perpendicular to the dual spikes upon which a user steps to insert the spikes into the ground thereby anchoring the umbrella into the ground. An alignment tab disposed on an upper attachment end of the support shaft and an alignment groove disposed on an opposite securement end of the support shaft assist in the insertion of the upper attachment end into the securement end while aligning and engaging a locking protrusion on the upper attachment end with one of the holes on the securement end to adjust the height of the support shaft. A protective cover including a snap-secured strap is also provided to removably contain and secure the spikes and the foot pad member during period of non-use to prevent personal injury due to accidental contact therewith.

FIELD OF THE INVENTION

The present invention relates to umbrellas and anchoring devices therefor, and more particularly, to a telescopic umbrella with integral dual-spiked anchor integrated into a unitary support shaft having a parallelepiped foot pad member perpendicular thereto for insertion into the ground, and also having an alignment tab and corresponding alignment groove on the upper attachment end and securement ends, respectively, of the support shaft to assist in the alignment and engagement of a locking protrusion on the upper attachment end with one of the holes on the securement end for height adjustment, and further having a protective cover having a snap-secured strap for containing and securing the spikes and the foot pad member therein during non-use.

SUMMARY OF THE INVENTION

The general purpose of the present telescopic umbrella with integral anchor, described subsequently in greater detail, is to provide a telescopic umbrella with integral anchor which has many novel features that result in a telescopic umbrella with integral anchor which is not anticipated, rendered obvious, suggested, or even implied by prior art, either alone or in combination thereof.

To accomplish this, the present telescopic umbrella with integral anchor including having parallel tapered dual spikes integrated into a unitary support shaft and anchored into the ground by stepping on a parallelepiped foot pad member perpendicular thereto without the requirement of separate components or tools, and also having an alignment tab and corresponding alignment groove on the upper attachment end and securement ends, respectively, of the support shaft to assist in the alignment and engagement of a locking protrusion on the upper attachment end with one of the holes on the securement end for height adjustment, and further having a protective cover having a snap-secured strap for containing and securing the spikes and the foot pad member therein during non-use.

The dual spikes have pointed tips for easier and more firm insertion and anchoring into the ground than other anchoring devices which have either blunter tips or helical anchoring members wrapped around the end of an umbrella anchor. The present device works well on grassy fields and different types of turf regardless of whether the ground is dry, wet, hard, or soft. In addition, the present device can be anchored into the ground at different angles to protect the user from the sun at different times of the day. The cover is fade resistant and water resistant for durability and unlimited re-use. The support shaft is formed of a durable material such as lightweight stainless steel or aluminum for manageable transport. The present device is useful for many types of outdoor activities, such as soccer games, baseball games, picnics, camping, and fishing.

Thus has been broadly outlined the more important features of the present telescopic umbrella with integral anchor so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
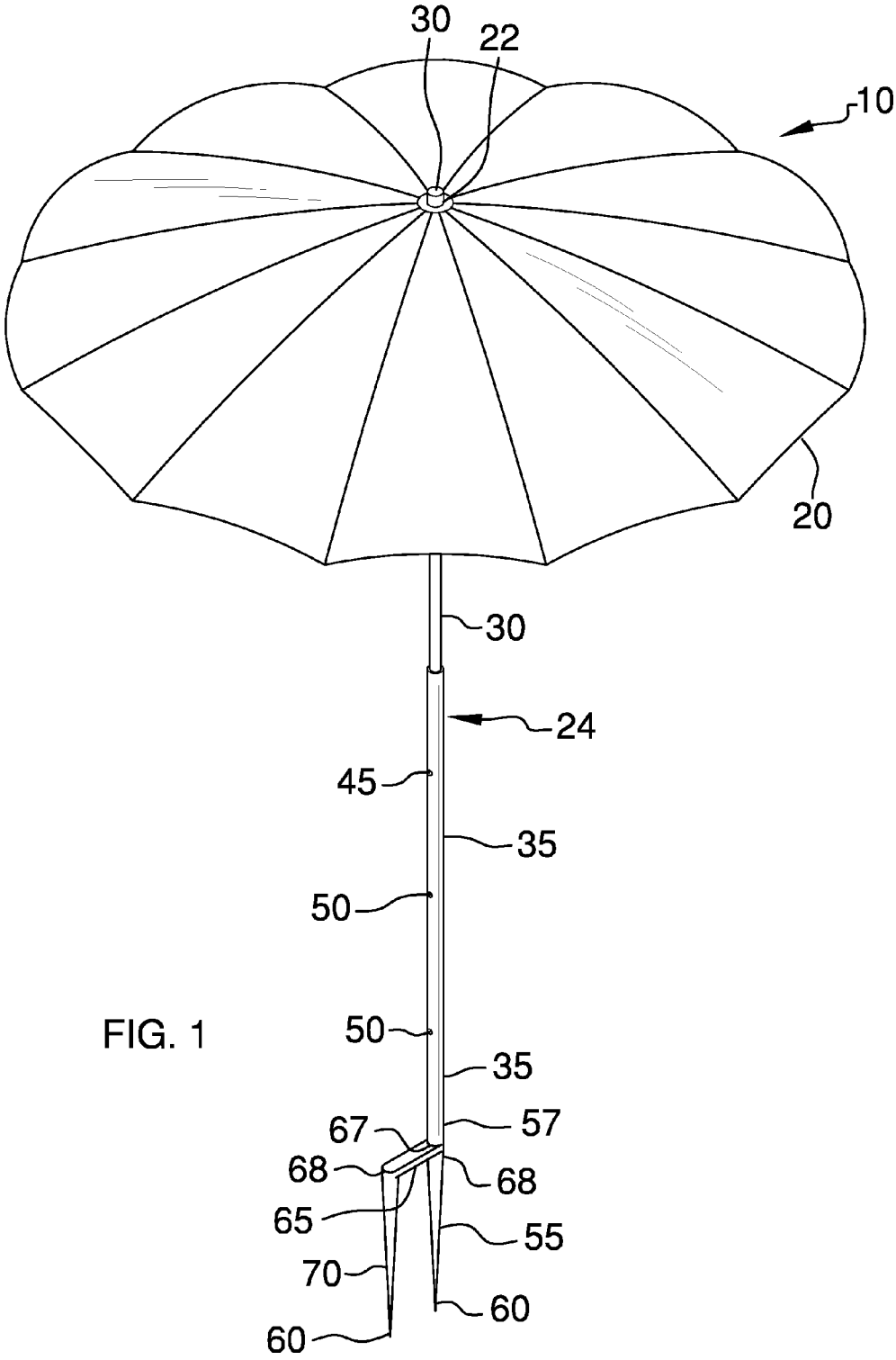
FIG. 1 is a front elevation view.
Figure 2:
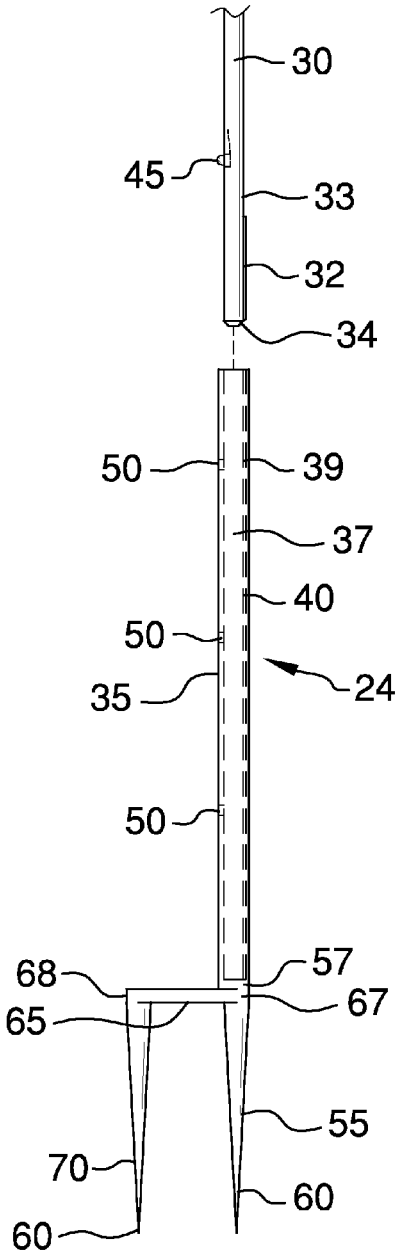
FIG. 2 is a exploded side view illustrating a telescopic support shaft.
Figure 3:
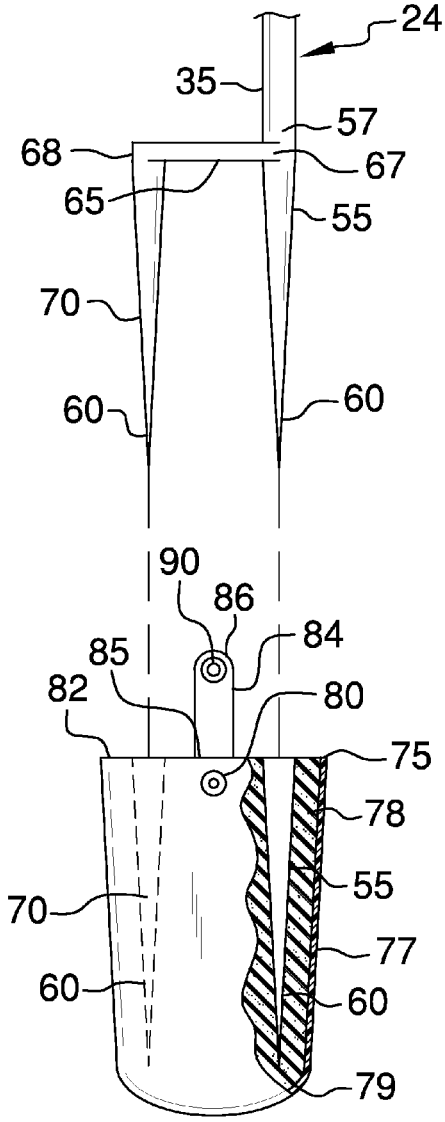
FIG. 3 is an exploded in-use view illustrating insertion of ground spikes into a protective cover.

With reference now to the drawings, and in particular FIGS. 1 through 3 thereof, example of the instant telescopic umbrella with integral anchor employing the principles and concepts of the present telescopic umbrella with integral anchor and generally designated by the reference number 10 will be described.

Referring to FIGS. 1 through 3 a preferred embodiment of the present telescopic umbrella with integral anchor 10 is illustrated. The telescopic umbrella with integral anchor 10 includes a multi-sectional sun umbrella canopy 20 having a centrally disposed attachment point 22. A telescopic cylindrical support shaft 24 removably slidingly attaches to the sun umbrella canopy 20. The telescopic support shaft 24 has an upper attachment end 30 that removably engages the attachment point 22 and an opposite unitary securement end 35. The upper attachment end 30 has a smaller diameter than the securement end 35 thus allowing the upper attachment end 30 to slidingly engage a channel 37 longitudinally disposed within the securement end 35. The upper attachment end 30 includes a vertically disposed alignment tab 32 along an outer edge 33 thereof proximal to a lower end 34 of the upper attachment end 30. The securement end 35 also includes a continuous alignment groove 39 vertically disposed along a first edge 40 of the channel 37.

A spring-loaded locking protrusion 45 is centrally disposed on the upper attachment end 30 in a position opposite the alignment tab 32. The unitary securement end 35 includes a plurality of spaced apart vertically aligned holes 50 disposed along the securement end 35. The locking protrusion 45 alternately removably engages one of the holes 50 whereby a length of the support shaft 24 is adjusted. The alignment tab slidingly engages the alignment groove 39 thereby assisting in the sliding engagement of the upper attachment end 30 within the securement end 35 channel 37 and in the alignment of the locking protrusion 45 with the holes 50 as well as further stabilizing the upper attachment end 30 with the securement end 35 channel 37.

A tapered first spike 55 structurally integral with the securement end 35 and disposed on a bottom end 57 of the securement end 35. The first spike 55 has a sharp pointed tip 60. The first spike 55 is positioned in vertical alignment with the support shaft 24.

A parallelepiped foot pad member 65 is disposed in a position perpendicular to the securement end 35 proximal to the first spike 55. The foot pad member 65 has an inside edge 67 attached to the bottom end 57 of securement end 35 proximal to a top end 68 of the first spike and an outside edge 68.

A tapered second spike 70 also having a sharp pointed tip 60 is structurally integral with the foot pad member 65. The second spike 70 is attached to the outside edge 68 of the foot pad member 65. The second spike 70 is disposed in a position parallel to the first spike 55. The second spike 70 has a length equal to a length of the first spike 55. The foot pad member 65 assists in the removal insertion of the first spike 55 and the second spike 70 into the ground by providing a structure upon which a user steps or alternately, hammers, to place a downward force thereon thus placing a downward force on the first and second spikes 55, 70 thereby firmly anchoring the first and second spikes 55, 70 in the ground and securing the umbrella canopy in place.

The present device 10 further includes an elongated cup-shaped protective cover 75 in which to store the first and second spikes 55, 70 as well as the foot pad member 65 to prevent personal injury due to accidental contact with the first and second spikes 55, 70 or due to accidental tripping over the foot pad member 65 during periods of non-use. The protective cover 75 has a continuous outer wall 77, a continuous inner wall 78, and an internal cavity 79 defined by the inner wall 78. The protective cover 75 internal cavity 79 removably receives the first spike 55, the foot pad member 65, and the second spike 70 therein.

A receiving snap member 80 is disposed on the outer wall 77 of the protective cover 75 proximal to a top edge 82 of the protective cover 75. A strap 84, which has a first end 85 attached to the top edge 82 of the protective cover 75 proximal to the receiving snap member 80 and a second end 86 on which an engagement snap member 90 is disposed, is also provided. The engagement snap member 90 removably secures the foot pad member 65 within the protective cover 75 upon insertion of the foot pad member 75 and first and second spikes 55, 70 into the protective cover 75 internal cavity 79. The engagement snap member 90 releasably engages the receiving snap member 80. The protective cover 75 outer wall 77 is formed of a hard, durable material while the inner wall 78 is formed of a soft material, including foam or soft lightweight rubber to maintain the sharpness of the first and second spike 55, 70 tips 60. In addition, the protective cover 75 is fade resistant and water resistant for durability and unlimited re-use of present device 10.

What is claimed is:

1. A telescopic umbrella with integral anchor comprising:

a multi-sectional sun umbrella canopy having a centrally disposed attachment point;

a telescopic cylindrical support shaft removably slidingly attached to the sun umbrella canopy, the telescopic support shaft having an upper attachment end engaging the attachment point and an opposite unitary securement end, wherein the upper attachment end has a smaller diameter than the securement end, wherein the upper attachment end slidingly engages a channel longitudinally disposed within the securement end;

a vertically disposed alignment tab along an outer edge thereof proximal to a lower end of the upper attachment end;

a spring-loaded locking protrusion centrally disposed on the upper attachment end in a position opposite the alignment tab;

wherein the unitary securement end further comprises:

a continuous alignment groove vertically disposed along a first edge of the channel;

wherein the alignment tab slidingly engages the alignment groove;

a plurality of spaced apart vertically aligned holes disposed along the securement end;

wherein the locking protrusion alternately removably engages one of the holes whereby a length of the support shaft is adjusted;

a tapered first spike structurally integral with the securement end and disposed on a bottom end of the securement end, the first spike having a sharp pointed tip, wherein the first spike is positioned in vertical alignment with the support shaft;

a parallelepiped foot pad member disposed in a position perpendicular to the bottom end of the securement end proximal to the first spike, the foot pad member having an inside edge attached to the securement end proximal to a top end of the first spike and an outside edge;

a tapered second spike structurally integral with the foot pad member, the second spike attached to the outside edge of the foot pad member, the second spike disposed in a position parallel to the first spike, the second spike having a length equal to a length of the first spike;

an elongated cup-shaped protective cover having a continuous outer wall, a continuous inner wall, and an internal cavity defined by the inner wall;

wherein the protective cover internal cavity removably receives the first spike, the foot pad member, and the second spike therein;

a receiving snap member disposed on the outer wall proximal to a top edge of the protective cover;

a strap having a first end attached to the top edge of the protective cover proximal to the receiving snap member and a second end;

an engagement snap member disposed on the second end of the strap;

wherein the engagement snap member removably secures the foot pad member within the protective cover upon insertion of the foot pad member into the protective cover internal cavity;

wherein the engagement snap member releasably engages the receiving snap member.

2. The umbrella of claim 1 wherein the protective cover outer wall is formed of a hard, durable material.

3. The umbrella of claim 2 wherein the protective cover inner wall is formed of a soft material.

4. The umbrella of claim 3 wherein the soft material is foam.

5. The umbrella of claim 4 wherein the protective cover is fade resistant and water resistant.

* * * * *